United States Patent [19]

Borucki

[11] 4,325,578

[45] Apr. 20, 1982

[54] SWING SEAT ASSEMBLY

[75] Inventor: Robert L. Borucki, Jenkintown, Pa.

[73] Assignee: Graco Metal Products, Inc., Elverson, Pa.

[21] Appl. No.: 151,087

[22] Filed: May 19, 1980

[51] Int. Cl.[3] ..... A63G 9/16

[52] U.S. Cl. ..... 297/281; 272/86; 272/85; 297/280; D6/1

[58] Field of Search ..... 297/281, 280, 457, DIG. 2; 272/85, 86

[56] References Cited

U.S. PATENT DOCUMENTS

| | | | |
|---|---|---|---|
| D. 228,268 | 9/1973 | Saint | D6/1 |
| D. 236,766 | 9/1975 | Speer | D6/1 |
| 257,873 | 5/1882 | Klein | 297/280 |
| 2,181,063 | 11/1939 | Miller | 297/281 |
| 2,990,007 | 6/1961 | Kessler | 297/457 X |
| 3,131,970 | 5/1964 | McGregor | 297/457 X |
| 3,528,657 | 9/1970 | Krupsky | 272/85 |
| 3,669,496 | 6/1972 | Chisholm | 297/457 X |
| 3,874,727 | 4/1975 | Mehbert et al. | 297/457 X |
| 3,883,136 | 5/1975 | Kim | 272/86 |
| 4,240,625 | 12/1980 | Meeker | 272/86 |

FOREIGN PATENT DOCUMENTS

| | | | |
|---|---|---|---|
| 2015887 | 9/1979 | United Kingdom | 272/85 |

*Primary Examiner*—Ramon S. Britts
*Assistant Examiner*—Peter A. Aschenbrenner
*Attorney, Agent, or Firm*—Seidel, Gonda, Goldhammer & Panitch

[57] ABSTRACT

The swing seat assembly includes a back portion adjustably connected to the bottom wall of a seat portion with said portions being molded in one piece with an integral hinge. Said portions having overlapping downwardly curved flanges thereby defining a tunnel on each side of the seat portion. A hanger for suspending the seat from above includes a pair of arms with each arm being connected to said seat portion at each tunnel.

8 Claims, 5 Drawing Figures

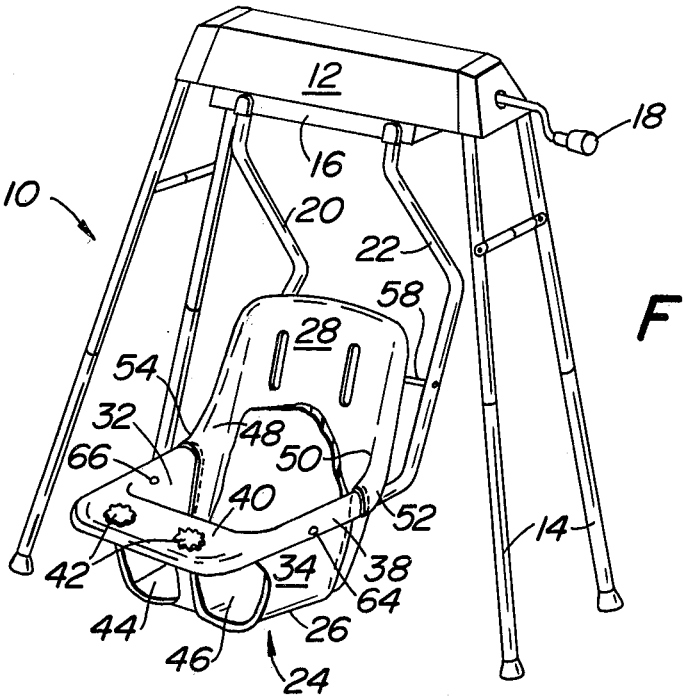
FIG. 1
FIG. 2
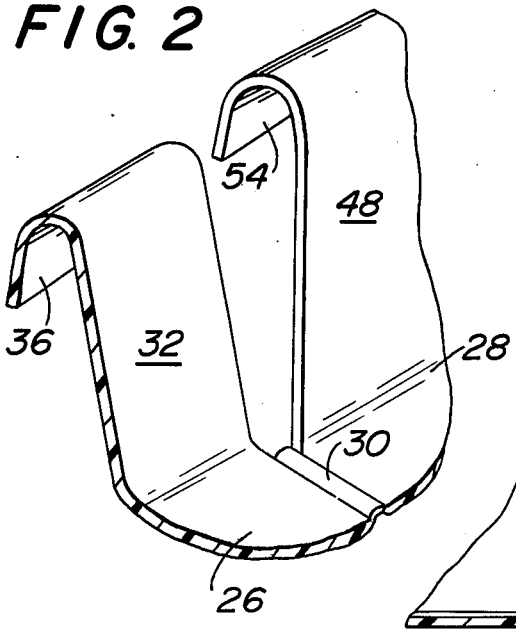
FIG. 5
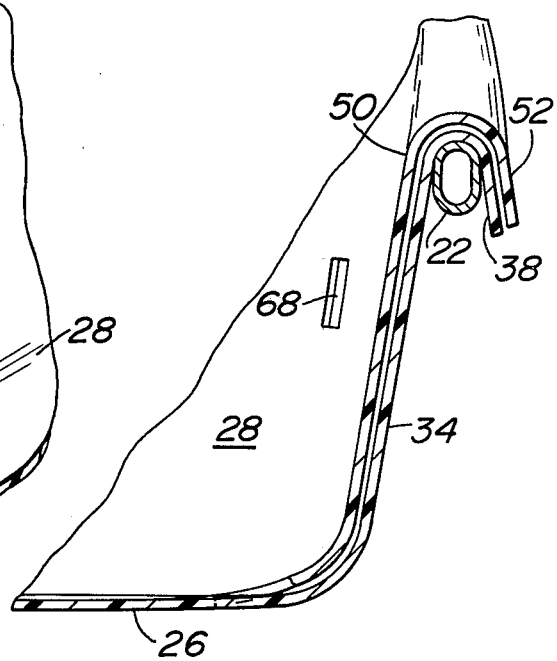

SWING SEAT ASSEMBLY

BACKGROUND

It is known from U.S. Design Pat. No. 236,766 to provide a child's swing seat with an integral tray at the front end thereof. It is known to make a seat and back integral in one molded piece with a hinge as taught by U.S. Pat. Nos. 3,131,970 and 3,669,496.

One problem with prior art swing seats is that they do not provide for adjustability of the back portion relative to the seat portion whereby the child may sit upright or lean back. Providing adjustability is a problem since it must be accomplished in a non-pinching manner. At the same time, it is desirable to make the seat portion and back portion one integral piece for purposes of production and cost economy. The present invention provides a solution to each of these problems.

SUMMARY OF THE INVENTION

The present invention is directed to a swing seat assembly wherein a back portion is adjustably connected to the bottom wall of a seat portion. The seat portion and back portion have overlapping downwardly curved flanges at their mating upper edges which are telescoped thereby defining a tunnel on each side of the seat portion. A hanger support is provided for suspending the seat portion from a swing thereabove. The hanger support includes a pair of hanger arm members. Each arm member is connected to the seat portion. A means is provided for adjusting the back portion relative to the seat portion.

It is an object of the present invention to provide a novel swing seat assembly which achieves economy in production by having the seat portion and back portion integral in one piece while being capable of adjustment relative to each other.

It is another object of the present invention to provide a swing seat assembly wherein a back portion is adjustably connected to a seat portion in a non-pinching manner.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a swing incorporating the present invention.

FIG. 2 is a partial perspective view of the joint between the seat portion and back portion on an enlarged scale.

FIG. 5 is a sectional view taken along the line 5—5 in FIG. 3.

Figure 3:
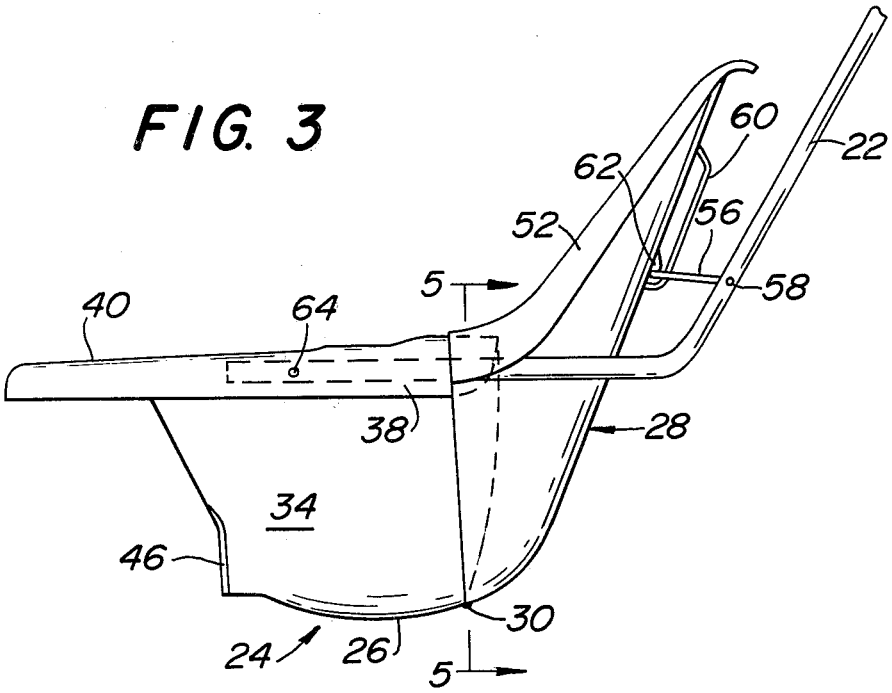
FIG. 3 is a side elevation view of the swing seat assembly with the back portion in one operative disposition.

Referrings to the drawings in detail, wherein like numerals indicate like elements, there is shown in FIG. 1 a swing designated generally as 10. Swing 10 includes a housing 12 supported at the upper end of two sets of converging legs 14. Housing 12 supports an oscillatable member 16. Member 16 may be oscillated by a handle 18 or by a motor not shown.

The swing seat assembly includes a pair of hanger support arm members designated 20 and 22 having their upper ends releasably coupled to the member 16. The members 20, 22 are identical and are generally U-shaped as illustrated. The lower ends of members 20 and 22 are removably connected to a swing seat designated generally as 24 in the same manner. Hence, only the details with respect to arm 22 and swing seat 24 will be described hereinafter.

The seat 24 includes a seat portion 26 and a back portion designated 28. The seat portion 26 and back portion 28 are pivotably connected together and are molded integral in one piece by way of a hinge 30. See FIG. 2. The thickness of the hinge 30 is less than the thickness of the portions 26, 28. The integral construction of the portions 26 and 28 by way of hinge 30 facilitates greater economy in production for a number of reasons and provides other advantages. Increased production is attained by making the portions 26, 28 at the same time in the same mold. Assembly of such portions together in order to be pivotably associated with another is eliminated. Inventory is reduced when there is only one integral unit as opposed to separate units.

The seat portion 26 has upstanding side walls 32 and 34. The upper edge of side wall 32 is provided with a downwardly curved flange 36. The upper edge of side wall 34 is similarly provided with a similar flange 38. The upper edge of the side walls 32, 34 are integral in one piece with a tray 40 which may be provided with attractive toys such as rotatable toy gears 42. The front wall of the seat portion 26 is below the tray 40 and contains leg openings 44, 46.

The back portion 28 is provided with side walls 48 and 50. The upper edge of side wall 50 is provided with a downwardly curved flange 52. The upper edge of side wall 48 is provided with a similar flange 54. The flanges 36 and 54 telescope with respect to one another. Likewise, the flanges 38 and 52 telescope with respect to one another. See FIG. 5. It is preferred that flange 52 overlie flange 38 in such telescoping relationship.

Figure 4:
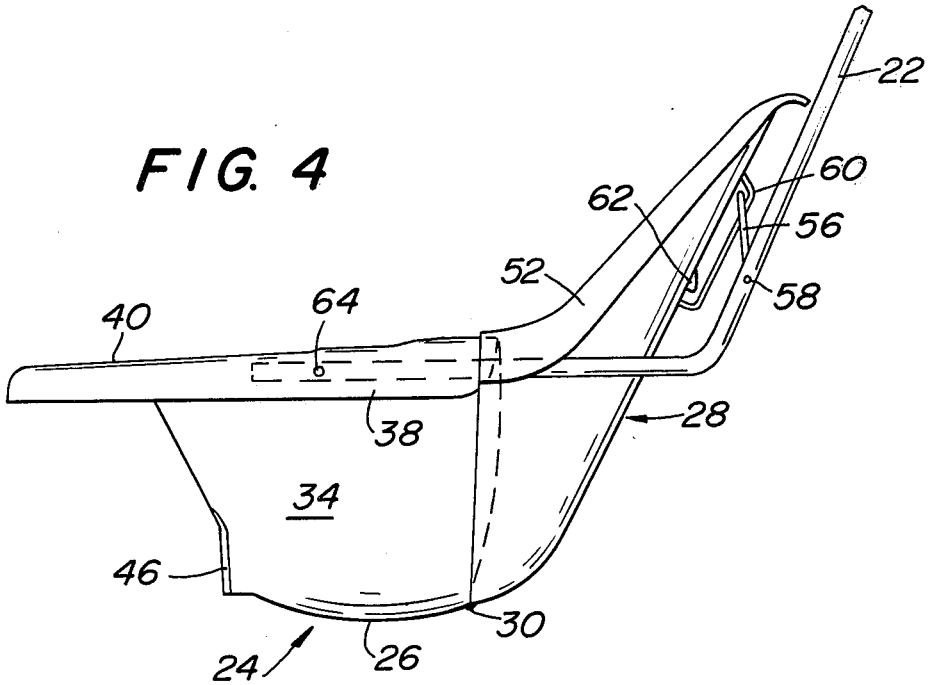
FIG. 4 is a view similar to FIG. 3 but showing the seat back in another operation disposition.

As shown more clearly in FIG. 3, the back portion 28 may pivot about hinge 30 relative to the seat portion 26 between the upright position as shown in FIG. 3 and the reclined position shown in FIG. 4. In each of the positions, the respective flanges on the seat portions 26, 28 remain telescoped so as to preclude any pinching of the child supported by the seat 24. Such adjustment of the back portion 28 relative to the seat portion 26 is attained by an adjustment wire member 56.

The adjustment wire member 56 is generally U-shaped with outwardly extending end portions 58 pivotably supported by the members 20, 22. The bight of the member 56 extends through loops 60 in the back portion 28. The loops 60 appear to be struck-out from the back portion so as to result in elongated slots as shown more clearly in FIG. 1. A lug 62 is provided on the rear surface of the back portion 28 for locking cooperation with the bight of member 56. Compare FIG. 3 with FIG. 4.

The lower end of the arm member 22 extends through the tunnel defined by the overlapping flanges 38, 52 on one side of the seat portion 26 and the lower end of arm member 20 extends through the tunnel defined by the telescoped flanges 36, 54 on the other side of the seat portion 26. A fastener 64 extends through aligned holes in the flange 38, arm member 22 and side wall 34. A similar fastener 66 joins the arm member 20 to seat portion 26 in a similar manner. The seat portion 26 and back portion 28 may be provided with removable padding if desired. If desired, a seatbelt may be provided for securing the child to the back portion 28. In this regard, the back portion 28 is provided with a pair of slots 68. Only one slot is shown in FIG. 5.

The adjustability of the back portion 28 relative to the seat portion 26 may be accomplished prior to a child occupying the swing seat 24 or during such occupancy. The adjustment wire member 56 is located behind the back portion 28 so that it may not be manipulated by the occupant of the seat 24. This provides a safety feature. The provision of a front wall on the seat portion 26 with only leg openings 44, 46 provides an added safety feature whereby by the child cannot exit from the seat 24 by way of an opening below the tray 40. Adjustability of the back portion 28 is attained without removing or disengaging any of the components whereby there are no loose components which tend to become lost. When the back portion 28 is in the reclined position as shown in FIG. 4, the bight of the curved flanges 52, 54 contact the respective arm members 22, 20 for resisting the pressure applied thereto by the child.

The present invention may be embodied in other specific forms without departing from the spirit or essential attributes thereof and, accordingly, reference should be made to the appended claims, rather than to the foregoing specification, as indicating the scope of the invention.

I claim:

1. A swing seat assembly comprising a back portion adjustably connected to a seat portion, said portions having overlapping downwardly curved flanges and mating upper edges thereby defining a tunnel on each side of the seat portion, and a hanger supported for suspending the seat portion from above, said hanger support including a pair of arms, each arm being connected to said seat portion.

2. An assembly in accordance with claim 1 wherein each of said arms extends through one of said tunnels and is fixedly secured by a fastener extending through mating holes in the arm and associated flange on the seat portion.

3. An assembly in accordance with claim 2 wherein said seat and back portions are molded in one piece with an integral hinge.

4. An assembly in accordance with claim 1 including cooperating means on the back portion and hanger for adjusting the back portion relative to the seat portion.

5. An assembly in accordance with claim 1 wherein said seat portion has a front wall, said front wall having leg holes therein.

6. An assembly in accordance with claim 1 wherein said arms are generally U-shaped, with one free end of the arms being at an elevation above the seat portion and adapted to couple the seat portion to a swing.

7. A swing seat assembly comprising a back portion adjustably connected to the bottom wall of a seat portion, said portions being molded in one piece with an integral hinge, said portions having overlapping downwardly curved flanges at mating upper edges thereby defining a tunnel on each side of the seat portion, a hanger support for suspending the seat from above, said support including a pair of arms, each arm extending through one of said tunnels and being fastened to the seat portion, cooperating means on the back portion and the hanger support for adjusting the position of the back portion relative to said seat portion, a front wall on said seat portion, said front wall having leg holes.

8. A swing comprising a housing supported by legs, said housing having an oscillatable portion, means for oscillating said portion, a swing assembly supported by said oscillatable portion, said assembly including a seat portion and a back portion connected thereto, said seat portion and back portion having overlapping downwardly curved flanges at mating upper edges and having a front wall provided with leg openings, a hanger suspending said seat portion from said oscillatable portion, and means for adjusting the back portion relative to said seat portion, said adjusting means including cooperating elements on said back portion and said hanger.

* * * * *